US005083675A

United States Patent [19]

Albanesi

[11] Patent Number: 5,083,675

[45] Date of Patent: Jan. 28, 1992

[54] EASY OPENING DEVICE FOR VACUUM PACKED POUCH PACKED AS A "BAG-IN-BOX"

[75] Inventor: Mario Albanesi, Rome, Italy

[73] Assignee: The Procter & Gamble Company, Cincinnati, Ohio

[21] Appl. No.: 635,093

[22] Filed: Dec. 28, 1990

[30] Foreign Application Priority Data

Dec. 29, 1989 [IT] Italy ..... 22329/89[U]

[51] Int. Cl.[5] ..... B65D 90/04

[52] U.S. Cl. ..... 220/462; 220/258; 220/270; 220/276; 220/359

[58] Field of Search ..... 220/463, 462, 461, 359, 220/276, 270, 258; 229/123.1

[56] References Cited

U.S. PATENT DOCUMENTS

| | | | |
|---|---|---|---|
| 22,247 | 12/1858 | Taylor | 220/359 |
| 1,882,343 | 10/1932 | Troth | 220/404 |
| 2,912,702 | 11/1959 | MacKenzie | 220/404 |
| 3,768,719 | 10/1973 | Johnson | 220/462 |
| 3,944,127 | 3/1976 | Bruke et al. | 220/462 |
| 4,350,250 | 9/1982 | Peters | 220/463 |
| 4,585,143 | 4/1986 | Fremow et al. | 220/462 |
| 4,724,979 | 2/1988 | Cleevely et al. | 220/258 |
| 4,736,870 | 4/1988 | Christensson | 220/461 |
| 4,978,056 | 12/1990 | Ball et al. | 220/359 |
| 5,007,231 | 4/1991 | Ingemann | 220/359 |

*Primary Examiner*—Stephen Marcus
*Assistant Examiner*—Christopher McDonald
*Attorney, Agent, or Firm*—Richard C. Witte

[57] ABSTRACT

A removal element is superposed on and joined to the periphery of an aperture which is preformed or precut on one face of a bag constituting part of a Bag-in-Box package.

A supporting framework is superposed on the removable element, certain edges of which framework, preferably two, approximately coincide with the edges of the removable part, while the other edges of the latter are covered by the body of the framework.

A margined corner of the removable part is left free to be grasped by the user in order to initiate the detachment and the tearing of the removable part. In order to facilitate the tearing, notches are provided, which are formed on one edge of the removable part. The tearing proceeds along the edges of the framework which cover the removable part so as to uncover, partially or entirely, the preformed or precut aperture which is present on one face of the bag.

6 Claims, 1 Drawing Sheet

EASY OPENING DEVICE FOR VACUUM PACKED POUCH PACKED AS A "BAG-IN-BOX"

TECHNICAL FIELD

This invention relates to a bag-in-box package and, more particularly, to a bag-in-box package having a removable element covering a preformed aperture or removable section of the bag.

BACKGROUND INFORMATION

A packaging system which is easy to open is very desirable. When a user must form an aperture in a bag by means of a cutting tool in order to use the contents, it is necessary to have such a tool to accomplish it. In addition, such an operation may prove to be difficult and, on occasion, dangerous.

Moreover, an aperture made with a cutting tool frequently proves to be aesthetically displeasing. If the aperture is made too small, it is necessary to tear the wall of the bag, aggravating the operation which was previously carried out.

SUMMARY OF THE INVENTION

The present invention relates to a pack comprising a bag, to one face of which there is applied a removable part, preferably heat welded, on which there is superposed a supporting framework, possibly cooperating with a cover and preferable adhesively attached to the bag, an aperture being preformed or precut on the abovementioned face of the bag and covered by the removable part which is partially or entirely capable of being peeled off and torn.

The present invention permits both the provision of a system which is easy to open and the obtaining of an aperture in the bag which is sufficiently large to permit an easy removal of its contents.

According to the present model, an aperture which is smooth and of rectangular shape is obtained by means of a removable element which is superposed on an aperture of the desired size, already preformed on the wall of a bag or partially delimited by weakening precuts, and is there caused to adhere in an expedient manner.

The bag containing the product is attached, by one of its faces, to a supporting framework, which may be equipped with a reclosable cover and which, in a preferred embodiment, is integral with the framework with hinged movement.

In the wall of the bag, in contact with the framework, there is an aperture which is preformed or can be formed along weakening precuts. The area of such aperture in the bag is covered by said removable part. The removable part is of such a size, and positioned in such a manner, that one or more of its edges are situated below the supporting framework and therefore concealed by the latter, while the remaining edges of the removable part are within the window delimited by the framework and therefore visible, with one corner of the removable part free in such a manner as to be able to be capable of being grasped in order to initiate the removal of the removable part. In this manner, one or more sides of the removable part may be peeled off or detached easily from the wall of the bag, leaving said aperture partially free, the entire freeing of which aperture will take place, as a result of the partial tearing of one or two edges of the removable part, facilitated by initial notches corresponding to the edges of the framework which direct such tearing. In a preferred embodiment, the bag containing the product is inserted into a substantially rigid container.

BRIEF DESCRIPTION OF THE DRAWINGS

The invention will now be described with reference to the accompanying drawing, which illustrates a preferred embodiment of the said invention.

In the drawing.

DESCRIPTION OF THE PREFERRED EMBODIMENT

Figure 1:
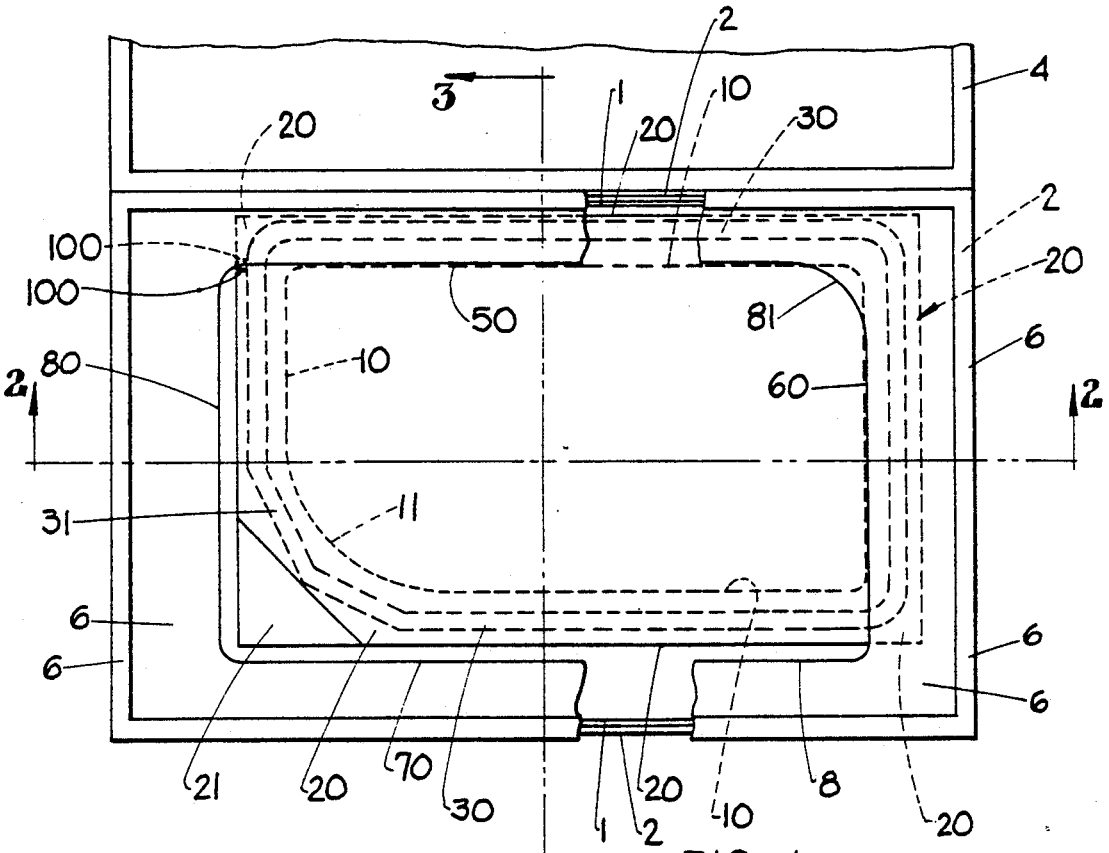
FIG. 1 shows, in plan view a non-limiting preferred embodiment of a pack with a removable element applied to a bag, disposed below a framework, with parts of the framework removed.
Figure 2:
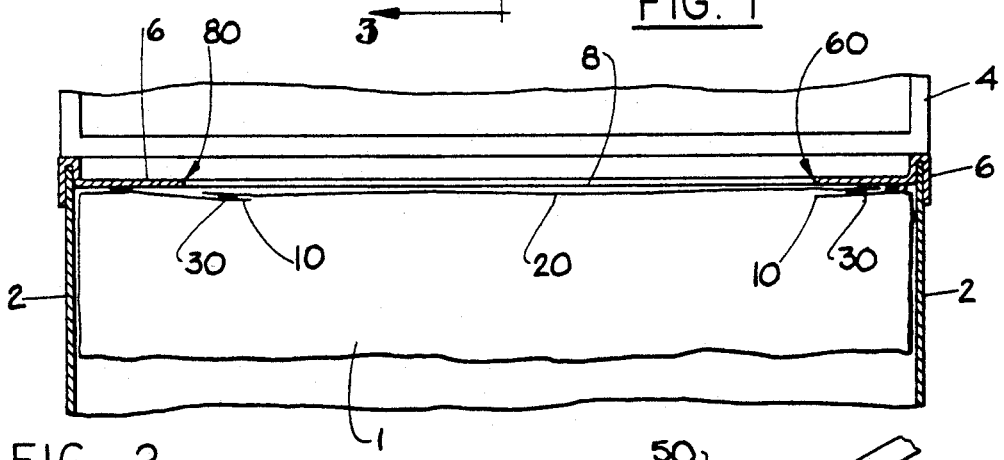
FIG. 2 represents said pack in fragmentary cross-section along the line 2—2 of FIG. 1.
Figure 3:
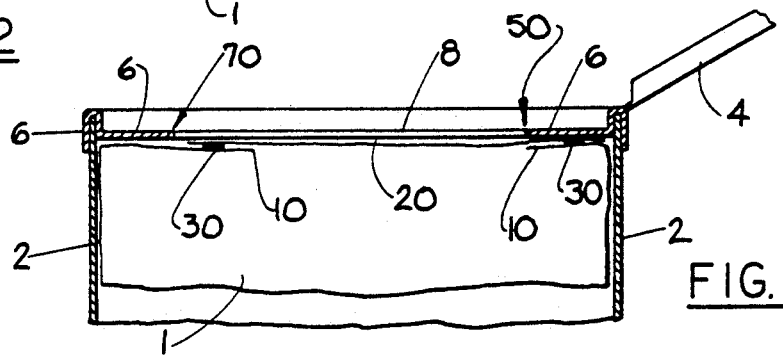
FIG. 3 represents such pack in fragmentary cross-section along the line 3—3 of FIG. 1.

In the figures, the bag 1 is represented as being inserted into a box-type container 2, which is equipped at the top with a supporting framework 6, on one side of which there may be attached a cover 4, for example with an integral hinge. The framework 6, adhesively attached to a wall of the bag, defines a substantially rectangular internal window 8. The bag 1 may comprise, on the face below the framework 6, an aperture which is preformed in a preferred embodiment, the peripheral edge of which is indicated by 10 or an area exhibiting weakening precuts to form such aperture, either of which is hereinafter referred to as a "preformed aperture". To close said preformed aperture 10, there is provided a removable element 20, which is shown overlapping the preformed aperture along the whole of its periphery. The removable element is caused to adhere, preferably by heat welding, to the wall of the bag along a peripheral outline, or lines of adhesion 30, a corner 21 of said removable part being left free within the window 8 of the framework, and thus visible, in order to be able to be grasped by the user for the purpose of initiating the detachment of the removable part and possibly together with a wall part of the bag along the precuts. From the corner 21, the adhesion outline 30 (heat welding or adhesive fixing or other) generally follows the path of the edge 10 of the aperture which is preformed or precut in the bag. The lines of adhesion 30 should be rupturable by the peeling force smaller than that required to tear the material from which the removable element is made.

Such aperture which is preformed or precut in the bag is provided in such a manner as to be approximately coincident with the internal edge of the framework 6 on one of the major sides, 50, and on the one which is perpendicular to this, 60, (see FIG. 1), while on the other two sides, 70 and 80 which are respectively opposite, the edge 10 of the aperture falls within the window 8 of the framework. Consequently, the adhesion outline 30, which joins the removable element to the bag, also remains covered below the edge of the framework 6 along the sides 50 and 60, being nevertheless visible along the sides 70 and 80. One or more precut notches 100 are provided on the upper left hand side of the removable part 20, in alignment with the internal upper edge 50 of the framework. In the position opposite the liftable corner 21 of the removable part, the angular line of the internal edge of the framework 6, indicated by 81, is rounded off to facilitate the tearing of the said removable part while changing direction.

The internal edges 50, 60 of the framework may exhibit a profile, for example saw-toothed or sharp-edged, which is suitable to facilitate the tearing of the removable part 20. In any event, it will also be recognized that the framework 6 must have sufficient resistance to flexure and torsion to permit the removal of removable element 20, as described below.

The removal of the removable element, considering the illustrative embodiment of FIG. 1 comprising an outer container 2, in order to have an access aperture of convenient size in one wall of a bag inserted into a container, takes place as follows. The user grasps the liftable edge 21 of the removable part 20, peeling it off from the bag essentially along its left-hand side and partially along its lower side, by virtue of the easy detachment characteristics exhibited by the connection between the removable part and the bag. After having lifted the removable part to the corner between the left-hand side 80 and upper side 50 of the framework 6, the notches 100 precut on the margin of the removable part trigger the tearing of the said removable part, which will continue along the entire upper side 50 of the internal edge of the framework and complete the peeling off on the lower side. At the corner between the sides 50 and 60, the tearing of the removable part is guided by the rounded-off edge 81 of the framework and will be capable of being continued, if desired, along the side 60, in order to complete cleanly and entirely the full freeing of the aperture 10 preformed in the bag.

As indicated previously, the preformed aperture on the wall of the bag can be obtained by means of discontinuous cutting of said wall, without removing the material circumscribed by the cut. The material which remains integral with the bag is retained at one or more points of discontinuity of the cut and can be made integral with the removable part by means of welding or firm adhesive attachment. Thus, on removal of the removable part, the material circumscribed by the cut is also removed, uncovering the aperture 10 in the wall of the bag.

What is claimed is:

1. A bag-in-box package comprising:

A. A box,

B. A bag within the box and containing a product therein, one wall of the bag having a preformed aperture therethrough which is sized to permit easy access for removal of the product from the bag, C. A support framework fastened to said one wall of the bag and having an interior opening which is of a configuration generally similar to that of the preformed aperture, said framework being fastened to said one wall at locations surrounding said preformed aperture, said interior opening having at least two edges which overlie corresponding edges of the preformed aperture and said interior opening also having at least two other edges which lie outwardly of other corresponding edges of the preformed aperture, and D. A removable element covering and overlapping the preformed aperture along the whole of its periphery, said removable element being adhered to said one wall adjacent said periphery along lines of adherence intermediate the said periphery and the locations at which said framework is fastened to said one wall, said removable element having a corner free of attachment and adapted to serve as a gripping tab, the corner being accessible and within the confines of the interior opening of said framework, the lines of adherence along the sides of the removable element which define said corner also being within the confines of the interior opening.

2. The package of claim 1 in which one or more notches are precut on an edge of the removable element, outside its line of adherence to said one wall, in order to facilitate the initiation of the tearing of the said removable element along an edge of said interior opening which overlies an edge of the preformed aperture.

3. The package of claim 1 in which the support framework has a reclosable lid associated therewith and serving to selectively cover or uncover the interior opening.

4. The package of any one of claims 1–3 in which, in a position opposite the said corner of the removable element, the junction of two edges of the interior opening is gently rounded to facilitate the continuation of tearing of the removable element along such edges.

5. The package of any one of claims 1–3 in which the lines of adherence joining the removable element to said one wall are rupturable by a peeling force which is smaller than the force required to tear the material from which the removable element is made.

6. The package of any one of claims 1–3 in which the edges of the interior opening which overlie corresponding edges of the preformed aperture are configured to facilitate the tearing of the material from which the removable element is made.

* * * * *